United States Patent [19]

Linnemann

[11] 4,250,638

[45] Feb. 17, 1981

[54] THREAD LASTED SHOES

[76] Inventor: Friedrich Linnemann, Lerchenweg 5, 4019 Monheim, Fed. Rep. of Germany

[21] Appl. No.: 20,319

[22] Filed: Mar. 14, 1979

[30] Foreign Application Priority Data

Jul. 6, 1978 [DE] Fed. Rep. of Germany ..... 2829645

[51] Int. Cl.[3] ..... A43B 3/14; A43B 9/10

[52] U.S. Cl. ..... 36/11; 36/16; 12/142 MC

[58] Field of Search ..... 36/11, 16, 17; 12/142 MC

[56] References Cited

U.S. PATENT DOCUMENTS 712,442 10/1902 Smith ..... 36/16

2,073,543 3/1937 Wernmark ..... 36/16 X 4,034,431 7/1977 Fukuoka ..... 36/11 X

FOREIGN PATENT DOCUMENTS 1504615 3/1978 United Kingdom ..... 36/11

*Primary Examiner*—James Kee Chi

*Attorney, Agent, or Firm*—Schwartz & Weinrieb

[57] ABSTRACT

A thread-lasted shoe has an upper which is stitched to a stitching edge of the sole of the shoe. In the area of the heel of the shoe, the stitching edge has stitching holes extending substantially parallel to the plane of the sole of the shoe whereas the stitching holes are inclined at an angle to the plane of the sole of the shoe over the remainder of said sole of the shoe. The said angle at which the stitching holes are inclined to the plane of said sole may be a right angle.

6 Claims, 3 Drawing Figures

THREAD LASTED SHOES

FIELD OF THE INVENTION

This invention relates to a thread-lasted shoe having an upper which is stitched to a stitching edge of the sole of a shoe.

BACKGROUND OF THE INVENTION

Thread-lasted shoes of this type are known under the name Gunther System. According to this shoe manufacturing process, the upper is stitched to a sole provided with previously produced stitching holes and the shoe is then shaped on a last in a few minutes after having previously been made supple with steam or hot water. The advantage of this process compared with earlier processes is that processing machines for the bottom of the shoe are not required. It is even possible to stitch together the upper and the sole on an out-work basis because, apart from a needle, no tools or machines are required. Compared with the also cheap to manufacture glued shoes those produced according to the Gunther System have the advantage of being harder wearing. They also have the advantage that the suppleness and porosity of the upper is not lost owing to the adhesive.

A shoe manufactured according to the Gunther System is for example described in German Gebrauchsmuster No. 78 03 394. In addition to the simple assembly of the upper on the sole, this shoe has the advantage that it is substantially water-tight owing to the border which passes round the inside and can therefore be considered as an allweather shoe. However, because of the seam which passes round the outside of the upper, it necessarily has the somewhat sporty appearance of a welted shoe, which is not always desired. This sporty appearance can be prevented by having the seam at right angles to the shoe sole plane. However, this would have the disadvantage that water could easily pass through the stitching holes into the inside of the shoe, so that the latter would no longer be suitable as an all-weather shoe.

SUMMARY OF THE INVENTION

The object of the invention is to so further develop a shoe of the type described hereinbefore that it can be manufactured extremely cheaply without special machines and tools, but which still has a very elegant and not too sporty appearance.

According to the invention, this object is achieved in a thread-lasted shoe having an upper which is stitched to a stitching edge of the sole of a shoe, by providing in the area of the heel of the shoe, the stitching edge with stitching holes parallel to the plane of the sole of the shoe whereas the stitching holes are inclined at an angle to the plane of the sole of the shoe over the remainder of said sole of the shoe. The angle at which the stitching holes are inclined to the plane of the shoe may be approximately 90°.

As a result of this constructional form, in the heel area the upper apart from the thickness of the stitching edge, is almost aligned with the outer contour of the heel, whereas in the remaining area of the shoe it springs back as in the case of a welted shoe. As a result, the shoe has an elegant appearance. Apart from this excellent aesthetic advantage, the shoe according to the invention also has numerous technical advantages. As a result of the stitching holes running parallel to the shoe sole plane in the heel area, the upper is more firmly connected to the sole in this area, where it is subjected to high tensile stresses when walking, than if the stitching holes were at right angles to the sole. However, the fundamental disadvantage of stitching holes introduced into the inside of the shoe is not disadvantageous in the heel area because, in the heel, the seam is raised to such an extent that there is little danger of water entering.

A further advantage of the invention is that the shoe according to the invention is not unnecessarily wider than the foot in the heel area. As a result, in use the shoes do not chafe against one another at the heel and consequently they neither wear nor assume an unattractive appearance.

From the manufacturing cost standpoint, it is an advantage that the horizontally directed back-stitching in the heel area is cheaper to make than the pricking stitch throughout the rest of the shoe. Thus, the shoe according to the invention is as a whole cheaper than a shoe having a seam through stitching holes at right angles through the plane of the shoe. Unlike glued shoes the shoe according to the invention is extremely flexible, very light and soft and adapts surprisingly well to the foot. The upper or body part of the shoe can be stitched in accurately fitting manner to the sole, so that unlike in conventional shoe manufacturing processes no excess material has to be ground away after stitching. Therefore, material consumption in the manufacture of the shoe according to the invention is particularly low.

According to an advantageous embodiment of the invention, a stitching groove is provided in the stitching edge in the shoe heel area on the outside of the heel. This stitching groove ensures that the seam does not project beyond the outer contour of the heel, thus preventing wear due to chafing when wearing the shoes.

The connection of the upper to the sole can be performed particularly simply by hand without using machines if according to a further development of the invention the stitching edge is provided with previously produced stitching holes.

According to another embodiment of the invention, parallel to the stitching edge on the inside of the shoe a raised water protection edge is provided, so that the shoe becomes an all-weather shoe. In addition, the foot is particularly well seated, which reduces the risk of the foot laterally overbalancing with the resulting danger of a sprain. The raised water protection edge also increases the walking and stepping comfort of the shoe. It also reduces the stressing of the upper, because lateral forces from the foot are directly passed to the sole via the water protection edge. The water protection edge can also be used as an adhesive edge for the prior fixing of the upper.

According to a further embodiment of the invention, in the shoe sole in the area of the heel, a recess is provided for receiving an inwardly folded over edge of the upper. This recess ensures that this edge of the upper folded inwards in the heel area does not bear on the shoe sole surface.

BRIEF DESCRIPTION OF THE DRAWINGS

The invention will now be further described, by way of example, with reference to the drawings, in which.

DETAILED DESCRIPTION OF THE PREFERRED EMBODIMENTS

Figure 1:
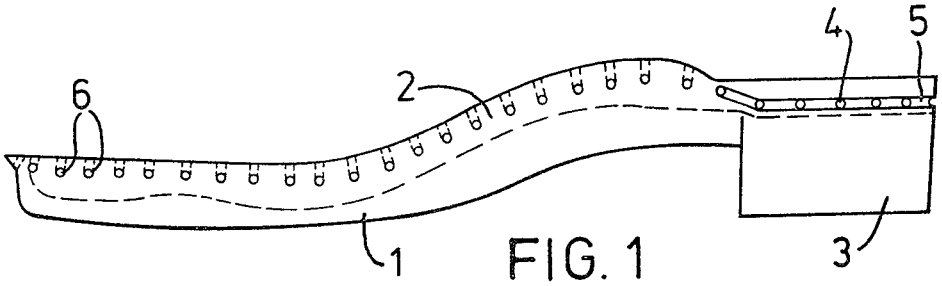
FIG. 1 is a side view of one embodiment of a sole for a shoe according to the invention.
Figure 2:
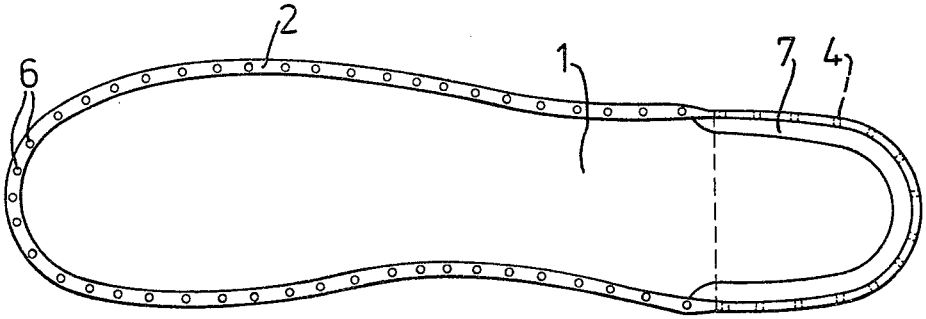
FIG. 2 is a plan view of the sole illustrated in FIG. 1.

Reference will first be made to FIGS. 1 and 2 of the drawings in which a sole 1 having the shape of a foot is preferably made by casting from polyurethane. A steel joint (not shown) can be provided in the sole 1. The sole 1 has a stitching edge 2 to which can be fixed an upper (not shown). Above the heel 3 of the sole 1, the stitching edge 2 is approximately aligned with the heel contour. Stitching holes 4 parallel to the plane of the sole 1 are provided in the stitching edge 2 in the area of the heel 3 and issue on the outside of the shoe into a stitching groove 5.

As is apparent from the front part of the sole shown in FIG. 1, the stitching edge 2 is directed outwards outside the heel 3, so that stitching holes 6 can be provided in the stitching edge 2 at right angles to the plane of the sole 1, said holes issuing on the outer surface of the shoe.

During stitching, the upper or body part is folded over inwards in the heel area and is placed with its wrapped-over edge in a recess 7 (FIG. 2). The recess 7 ensures that the upper does not exert a bearing action. A covering sole (not shown) can cover the fold of the upper in the upwards direction. The upper is then fixed to the sole in the area of the heel 3 by means of a backstitch. Throughout the rest of the shoe, the upper is folded outwards and it is stitched to the sole 1 in the vicinity of stitching holes 6 using a pricking stitch.

Figure 3:
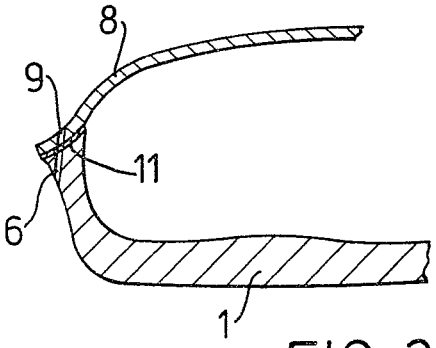
FIG. 3 is a partial section through a second embodiment of a shoe according to the invention in the connection area of the upper and sole in the front part of the shoe.

The embodiment shown in FIG. 3 differs from the previously described embodiment in that an upper 8 engages in an inclined manner on a raised water protection edge 11 located within the upper 8. Holes 9 in the upper 8 and inclined stitching holes 6 which issue to the outside of the shoe permit the connection of the upper 8 to the sole 1. The water protection edge 11 protects the inside of the shoe from the entry of water from the outside and can be provided not only in the front part of the shoe, but also in the area of the heel 3, so that in the latter area, despite the inwardly directed stitching holes 4, the penetration of water can be prevented.

The invention is not limited to the embodiments described and represented hereinbefore and various modifications can be made thereto without departing from the scope of the invention as defined by the appended claims.

I claim:

1. In a thread-lasted shoe having an upper which is stitched to a stitching edge of the sole of said shoe, the improvement comprising:

two different stitching means, defined between said shoe upper and said shoe sole and confined to predetermined separate portions of said shoe, for securing said shoe upper to said shoe sole, a first one of said two stitching means being defined by stitching holes defined solely within a plane substantially parallel to the plane of said shoe sole and being confined solely within the heel portion of said shoe, and a second one of said two stitching means being defined by stitching holes defined solely within planes inclined at a predetermined angle with respect to said plane of said shoe sole and being confined solely within those portions of said shoe other than said heel portion of said shoe.

2. A thread-lasted shoe as claimed in claim 1, in which said angle at which said stitching holes are inclined to the plane of said sole is approximately 90°.

3. A thread-lasted shoe as claimed in claim 1, in which a stitching groove is provided in the stitching edge in the area of the heel of the shoe and on the outside of said heel.

4. A thread-lasted shoe as claimed in claim 1, in which the stitching edge is provided with previously made stitching holes.

5. A thread-lasted shoe as claimed in claim 1, in which a raised water protection edge is provided on the inside of the shoe, said water protection edge extending essentially parallel to said stitching edge.

6. A thread-lasted shoe as claimed in claim 1, in which a recess for receiving an inwardly folded edge of the upper is provided in the sole of the shoe in the heel area.

* * * * *